United States Patent [19]

Martin

[11] Patent Number: 4,568,306

[45] Date of Patent: Feb. 4, 1986

[54] UNICYCLE TOY

[76] Inventor: John E. Martin, 5 Belfast Rd., Timonium, Md. 21093

[21] Appl. No.: 593,599

[22] Filed: Mar. 26, 1984

[51] Int. Cl.[4] ..... A63H 17/00; A63H 29/00; A63H 17/36

[52] U.S. Cl. ..... 446/437; 446/443; 446/456; 446/460; 446/470

[58] Field of Search ..... 446/154, 431, 433, 437, 446/440, 444, 445, 454, 450, 456, 458, 457, 462, 468, 470; 406/185

[56] References Cited

U.S. PATENT DOCUMENTS

| | | | |
|---|---|---|---|
| 244,296 | 7/1881 | Prosser | 305/7 |
| 1,148,956 | 8/1915 | Collins | 406/185 |
| 2,638,347 | 5/1953 | Maggi | 446/485 X |
| 3,260,324 | 7/1966 | Suarez | 180/10 |
| 3,667,156 | 6/1972 | Tomiyama et al. | 446/458 |
| 3,696,557 | 10/1972 | Ruppel | 46/243 M |
| 3,722,134 | 3/1973 | Merrill et al. | 446/462 |
| 3,777,835 | 12/1973 | Bourne | 180/10 |
| 4,080,602 | 3/1978 | Hattori | 343/225 |
| 4,109,741 | 8/1978 | Gabriel | 180/21 |
| 4,194,737 | 3/1980 | Farmer | 273/58 BA |
| 4,386,787 | 6/1983 | Maplethorpe et al. | 180/10 |
| 4,438,588 | 3/1984 | Martin | 446/154 X |
| 4,471,567 | 9/1984 | Martin | 446/437 |

FOREIGN PATENT DOCUMENTS

| | | | |
|---|---|---|---|
| 1292441 | 10/1972 | United Kingdom | 446/456 |
| 2119266 | 11/1982 | United Kingdom | 446/462 |

*Primary Examiner*—Robert A. Hafer
*Assistant Examiner*—D. Neal Muir
*Attorney, Agent, or Firm*—John F. McClellan, Sr.

[57] ABSTRACT

A combined tire and radio-controlled powered vehicle substantially concealed within the tire produce in combination the facility to roll across flat surfaces and to turn corners at considerable speed, leaning into the direction of turn. The vehicle has the following wheels: two rear drive wheels, one front steerable wheel, and two upright-axle wheels at the sides near the front steerable wheel enable the powered vehicle to swerve against either tire sidewall on command, and to some extent to climb it, steering the tire and driving it. The vehicle has a body curve in elevational view similar to the tire perimeter curvature.

6 Claims, 6 Drawing Figures

UNICYCLE TOY

Cross-reference is made to my copending applications for U.S. Patent, Ser. No. 427,890 filed 9-29-82 for REMOTECONTROL BALL which as U.S. Pat. No. 4,438,588 on 3-27-84; Ser. No. 448,421 filed 12-10-82 for TWO-WAY OPERATING BALL ENCLOSED VEHICLE and Ser. No. 564,838, filed 12-23-83 for RADIO CONTROLLED VEHICLE WITHIN A SPHERE.

FIELD OF THE INVENTION

This invention relates generally to powered land vehicles and specifically to a unicycle toy that can be remotely controlled.

BACKGROUND OF THE INVENTION

My copending applications listed above teach generally variations on a powered vehicle inside a sphere and driving the sphere. Radio control of the powered vehicle may include steering, forward and reverse. The drive and steering box may be as set out in my said Application No. 564,838.

The following U.S. patents are pertinent to the field of the invention in some aspect or another;

No. 244,296 to T. T. Prosser, 7-12-1881 showed a wheeled vehicle E within a wheel B;

No. 3,260,324 to C. R. Suarez, 7-12-66, showed a motorized unicycle with steering by leaning of the driver;

No. 3,696,557 to R. Ruppel, 10-10-72, showed a powered toy within a wheel; evidently there was no provision for steering except for a rail along which the toy was constrained to travel;

No. 3,777,835 to R. C. Bourne, 12-11-73, showed a one-wheel, powered vehicle in which the direction of travel is changed by shift of the operator's weight;

No. 4,080,602 to T. Hattori et al, 3-21-78, showed a wireless control for toys;

No. 4,109,741 to C. L. Gabriel, 8-29-78, showed a motorized unicycle with external provisions for carrying a passenger;

No. 4,194,737 to W. R. Farmer, 3-25-80, showed a spherical device with magnetic areas and inside it another spherical device which had similar areas;

No. 4,386,787 to C. Maplethorpe et al. 6-7-83, showeda spherical vehicle with traction wheels of a carriage inside the sphere bearing on the interior of the sphere, however, steering of the powered embodiment appeared to be by shifting operator weight.

SUMMARY OF THE INVENTION

A principle object of this invention is to provide a remotely controllable tire of the type used on automobiles, but in preferred embodiment of semi-rigid plastic closely imitating an automobile tire. The remote control includes radio control of start-up, steering, forward and reverse, and stop.

Further objects are to provide a system as described that is unobtrusive, so that the tire can appear to the casual observer as if actuating itself, that has a low center of gravity, that can cause the tire to lean into turns so as to resist overbalancing and falling, and that can turn the tire in a complete circle to left or right, as desired.

Yet further objects are to provide a system as described that can be the basis for competitive games enjoyable by all, in running the tire through obstacle courses, as from room to room and around furniture, but that is safe for people, furniture, and walls and flooring.

Still further objects are to provide a system as described that is easy to assemble and disassemble, with good access for installation of the powered vehicle in the tire and for removal from it.

In brief summary the invention provides a combined tire and radio-controlled powered vehicle substantially concealed within the tire to produce in combination the facility to roll across flat surfaces and to turn corners at considerable speed, leaning into the direction of turn. The vehicle has the following wheels: two rear drive wheels, one front steerable wheel, and two upright-axle wheels at the sides near the front; the steerable wheel enables the powered vehicle to swerve against either tire sidewall on command, and to some extent to climb it, steering the tire and driving it. The vehicle has a body curve, in elevational view similar to the tire perimeter curvature.

The above and other objects and advantages of this invention will become more readily apparent on examination of the following description, including the drawings in which like reference numerals refer to like parts.

DETAILED DESCRIPTION

Figure 1:
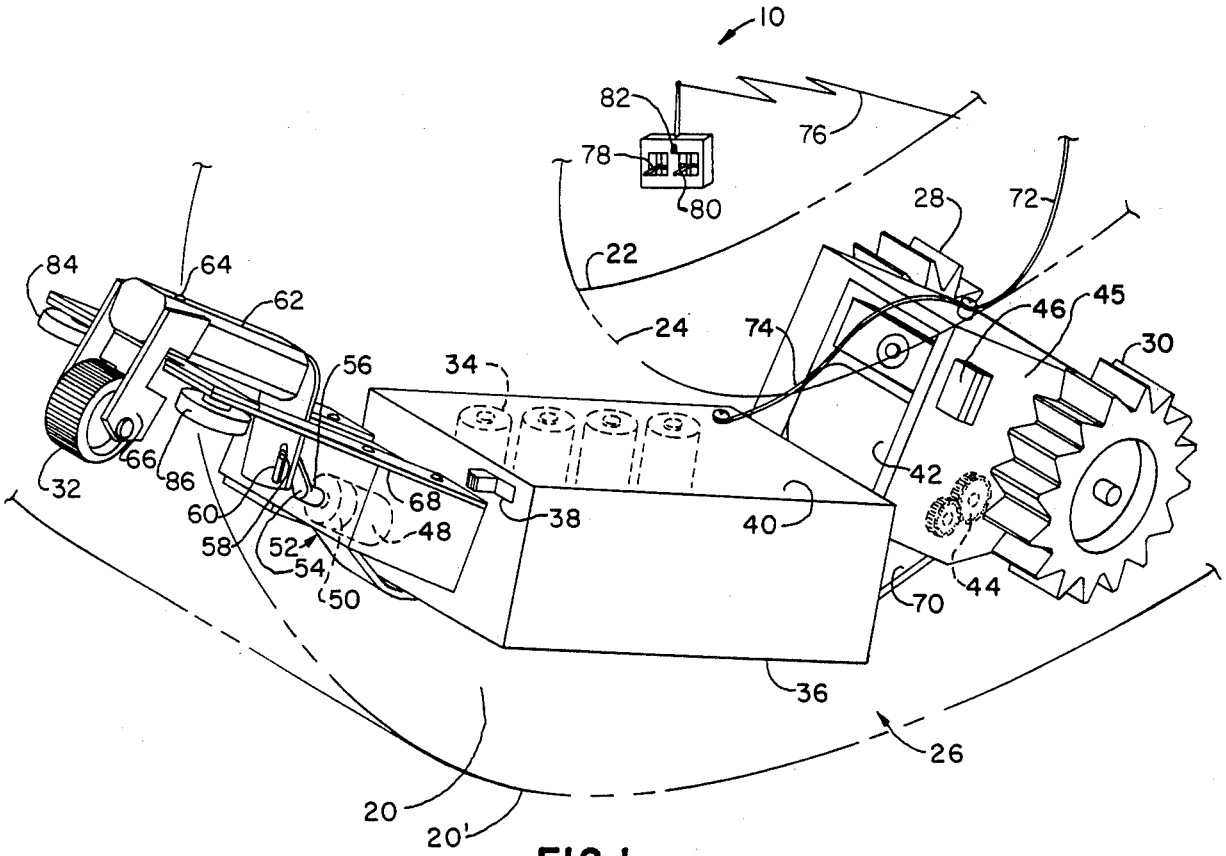
FIG. 1 is a perspective view of the preferred embodiment of this invention, the tire portion shown fragmentarily and in phantom view, for exposition.

FIG 1 shows, fragmentarily, embodiment 10 of the invention, an automobile type tire, preferably of semi-rigid black plastic and shown in phantom lines.

The tire 20 is of the type having opposed inner peripheries 22, 24 closer together than the greatest sectional width, and also is the type that can stand upright on the substantially flat outer perimeter or tread. A self-powered remote control vehicle 26 is substantially enclosed within the tire by this structure and by the fact that the sectional height of the tire sidewalls is substantially greater than that of the vehicle 26.

The vehicle comprises a body mounted on three wheels, two 28, 30 coaxially aligned at the rear and one 32 centrally located in front.

Power is supplied by a plurality of dry-cell batteries 34 in the midbody 36, and passes through a manual on-off switch 38 to a radio receiving and ampifying section of 40. From this section, power is supplied to the rear wheels 28, 30 through a motor 42 and gearbox 44 in the rear body portion 45. Gear selector 46 slides from left (high speed) to right (low speed) to produce selected speed.

Steering power is supplied from section 40 to a steering motor 48 and gearbox 50 in the forward body portion 52, behind the steerable wheel 32. To turn the steerable wheel 32 from one side to the other, a crank arm 54 extending forwardly from the axis of the gearbox output shaft 56, swings a crankpin 58 in a lateral arc. Engagement of the crankpin 58 in slot 60 of steering lever 62 pivots the lever about upright steering axle 64 and turns the pair of forks 66 carrying the steering wheel 32 ahead of the vertical axle, steering the vehicle 26. Frame 68 extending forwardly from the midbody supports the mechanism ahead of the midbody, and similarly, frame 70 extending rearwardly from the midbody supports the mechanism rearwardly of it.

An important feature of the invention is the provision of a low profile and a low center of gravity by means of having the frame bent in an arc downwardly, producing in this elongate vehicle the general curve of the tire circumference 20'. The body of the vehicle may advantageously be of substantially uniform width, front to back.

Antenna 72 receives, and transmits by line 74 to the receiver 40, signals 76 from the remote radio transmitter, selected by handles 78 and 80. Handle 78 in the "up" position causes the driven wheels 28, 30 to rotate in forwardly propelling direction and in the down position to reverse. Handle 80 causes the steering motor to turn the steering wheel to left or right in accordance with the left/right position of the handle. An on-off switch 82 is provided on the transmitter to conserve the power of batteries in it.

A further important feature of the invention is provision at the forward or steering end of the vehicle 26 about mid-way the height of the vehicle and adjacent the front wheel or steering wheel, two tire sidewall-engaging wheels 84, 86, or lateral wheels, each having an axle aligned generally radially of the tire center of rotation and extending on respective sides beyond the frame 68. The extreme dimension from the outer periphery of one of these two wheels to the outer periphery of the other of these two wheels is preferably about one-half to two thirds the greatest inside width of the tire section at the height contacted by the wheels.

Figure 2:
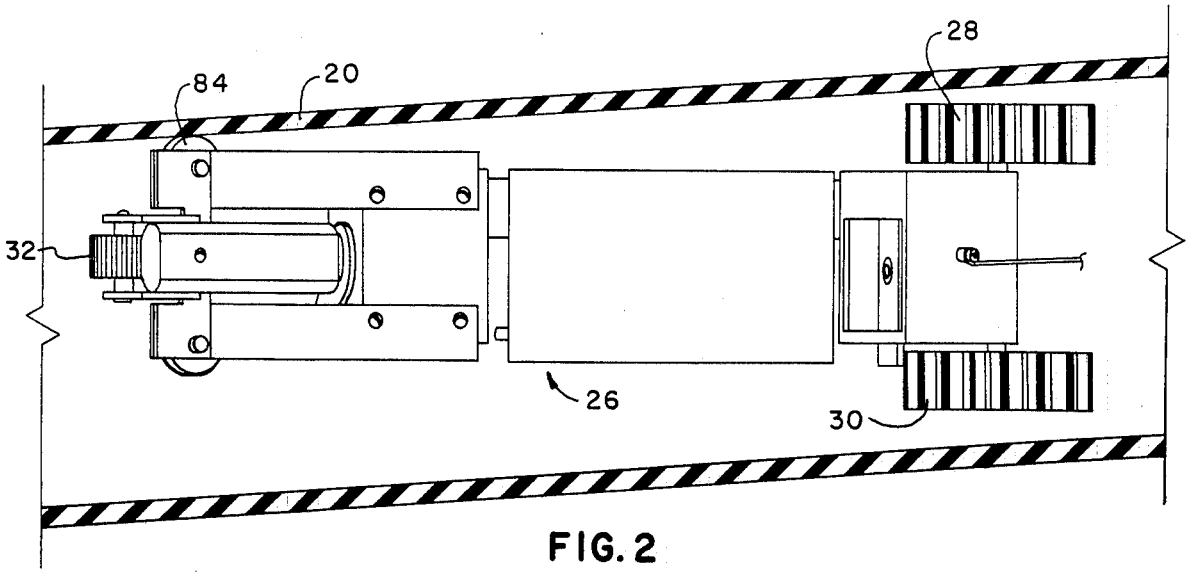
FIG. 2 is a top plan view thereof with the tire portion shown with a portion removed for exposition.
Figure 3:
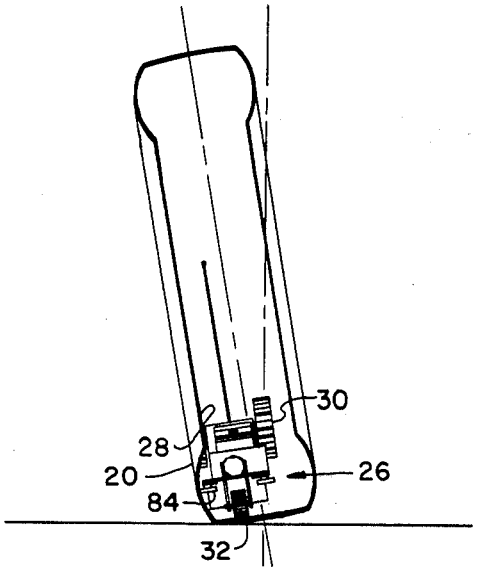
FIG. 3 is a perspective view thereof, showing a front elevational aspect of the invention, the tire having a portion removed, for exposition.

FIGS. 2 and 3 show respectively in plan view and in elevational view how the powered vehicle 26 when steered to one side of the tire 20 (to the right side in the diagrams) climbs the tire wall slightly and leans its weight over against that side by means both of the rear wheels 28, 30 and the adjacent sidewall-engaging wheel 84. This combined action does the difficult job of steering the tire but maintaining steady motion of the tire. It tips the tire in the direction it is to go and yet keeps drive friction low. Cog-tread type rear wheels are preferred for this, and the front or steering wheel 32 preferably has a soft rubber tire with skid-resistant treads. Contact of the sidewall-engaging wheels with the tire is preferably at a mid-portion of the tire sidewall height.

Figure 4:
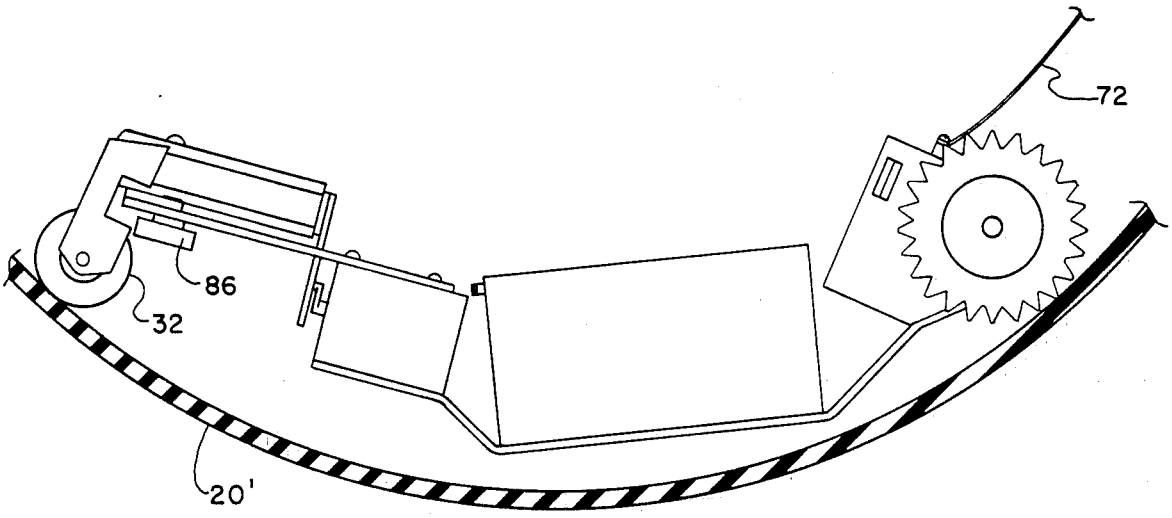
FIG. 4 is a side elevational view with a sectional fragment of the tire shown.

FIG. 4 shows in side elevational view how the vehicle body has the general curvature of the periphery 20' of the tire, the proximity of the tire sidewall contacting wheels, 86 shown, to the steering wheel 32, the vehicle concealed behind the tire sidewalls, and the antenna 72 preferred deployment, trailing in the curve of the tire so that it is free of contact but concealed. To those seeing the tire apparently navigating by itself, it is startling.

Figure 5:
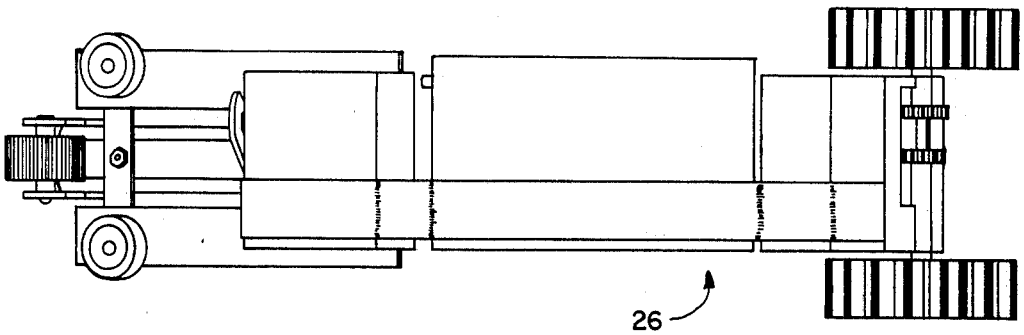
FIG. 5 is a bottom plan view of the powered vehicle.
Figure 6:
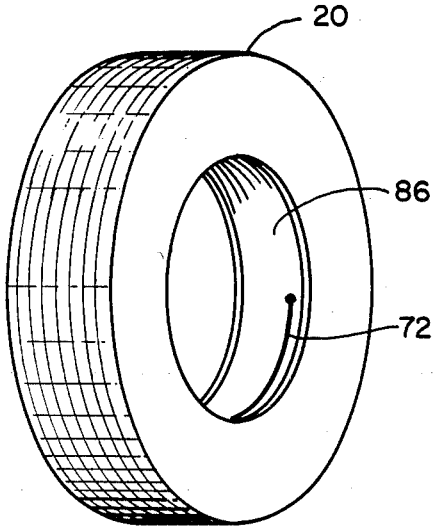
Fig. 6 is a perspective view of a tire with a portion of the invention visible in it.

FIG. 5 shows the bottom plan view of the vehicle 26. FIG. 6 is a perspecitve view of a typical tire 20 for use with the invention. A portion of a vehicle according to this invention in the tire, an antenna 72, can be seen in annular opening 86 between the sidewalls.

The basic components for the radio controlled driving and steering provisions are obtainable from many widely marketed toys of the radio-controlled type. A preferred source of these is the Firefox Radio Control Off Road Racer No. 1125B, Shinsel Corp., 12951 E. 166th Street, Ceritos, Calif. 90701. Any adaptation necessary requires no change in the radio control provisions. The vehicle is made proportionally long and narrow so that it is easy to install and to remove.

The preferred plastic tire is No. 3773 obtainable from Miner Industries, Inc., N.Y., N.Y. 10010.

Dimensions:

tire O.D.-18 inches (46 cm)
tire I.D.-12 inches (30.5 cm)
tire width (max.)-5½ inches (14 cm)
tire thickness-1/16 inch (1.5 mm)
vehicle height (max)-2¾ inches (7 cm)
vehicle length-14 inches (35.5 cm)
vehicle greatest width:
across drive wheels-4 inches (10 cm)
across sidewall engaging wheels-3 inches (7.5 cm)
clearance with midbody resting on floor:
beneath drive wheels-1½ inches (4 cm)
beneath steering wheel-2 inches (5 cm)
vehicle weight, approx.-2.2 lbs. (1 kg)

The tire cross-sectional shape is approximately that shown in FIG. 3.

In conclusion, the surprising co-active ability of this combined mechanism to roll across a flat surface, in forward and in reverse, and to turn corners at considerable speed without upsetting, is not completely understood but is appreciated as a fun-filled phenomenon.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system having a powered vehicle with a plurality of wheels for running on the inner surface of and rotating a circular member and means for remotely controlling said powered vehicle in steering direction and in forward/reverse direction of operation, the improvement comprising: said circular member being an automobile type tire with an outer perimeter and first and second sidewalls each sidewall having an inner perimeter defining a circular opening, said openings being axially aligned and spaced apart, said inner and outer perimeter and said sidewalls forming an annular volume in the tire, between means included on said powered vehicle to effect a turning of said tire responsive to a steering change of said powered vehicle therewithin, and means for substantially concealing said powered vehicle within the tire, comprising said powered vehicle proportioned for being contained within said annular volume.

2. In a system having a powered vehicle with a plurality of wheels for running on the inner surface of and rotating a circular member and means for remotely controlling said powered vehicle in steering direction and in forward/reverse direction of operation, the improvement comprising: said circular member being an automobile type tire with an outer perimeter and first and second sidewalls forming an annular opening in the tire between the first and second sidewalls, means included on said powered vehicle for steering the tire, means for substantially concealing said powered vehicle within the tire; said plurality of wheels including a steerable wheel at a first end of the powered vehicle and at least one drive wheel at a second end of the powered vehicle; said means for steering the tire including; first and second lateral wheels mounted adjacent respective sides of said steerable wheel on respective axes generally radial to the tire center of rotation, the first lateral wheel being in position to bear against the first sidewall when the powered vehicle is steered in one direction during driving by said at least one drive wheel, and the second lateral wheel being in position to bear against the second sidewall when the powered vehicle is steered in another direction during driving by said at least one drive wheel, thereby steering said tire.

3. In a system as recited in claim 2, said means for substantially concealing comprising said powered vehicle having all along the length thereof a height less than the height of said first and second sidewalls.

4. In a system as recited in claim 3, means producing a substantially low center of gravity for said powered vehicle including said powered vehicle having a curvature similar to said tire, and said powered vehicle curvature contributing to said height of the powered vehicle being less than said height of the first and second sidewalls.

5. In a system as recited in claim 2, means for causing said tire to lean in the direction in which steered, comprising said bearing on a sidewall by a lateral wheel being in a middle portion of the height of said sidewall.

6. In a system as recited in claim 2, the first and second sidewalls having a spacing therebetween greater than the greatest distance across said lateral wheels.

* * * * *